US010190200B2

(12) United States Patent
Heymes et al.

(10) Patent No.: US 10,190,200 B2
(45) Date of Patent: Jan. 29, 2019

(54) ALUMINUM-COPPER-LITHIUM PRODUCTS

(71) Applicant: CONSTELLIUM FRANCE, Paris (FR)

(72) Inventors: Fabrice Heymes, Ventabren (FR); Frank Eberl, Issoire (FR); Gaelle Pouget, Grenoble (FR)

(73) Assignee: CONSTELLIUM ISSOIRE, Issoire (FR)

( * ) Notice: Subject to any disclaimer, the term of this patent is extended or adjusted under 35 U.S.C. 154(b) by 1045 days.

(21) Appl. No.: 13/733,720

(22) Filed: Jan. 3, 2013

(65) Prior Publication Data

US 2013/0255839 A1 Oct. 3, 2013

Related U.S. Application Data

(63) Continuation of application No. 12/617,803, filed on Nov. 13, 2009, now Pat. No. 8,366,839.

(Continued)

(51) Int. Cl.

*C22F 1/057* (2006.01)
*C22C 21/00* (2006.01)

(Continued)

(52) U.S. Cl.

CPC ..... *C22F 1/057* (2013.01); *C22C 21/00* (2013.01); *C22C 21/16* (2013.01); *C22F 1/04* (2013.01)

(58) Field of Classification Search

CPC ..... C22F 1/057

(Continued)

(56) References Cited

U.S. PATENT DOCUMENTS 5,032,359 A 7/1991 Pickens et al.
5,198,045 A * 3/1993 Cho ..... C22C 21/12 148/417

(Continued)

FOREIGN PATENT DOCUMENTS

FR 2894985 A1 6/2007
FR 2900160 A1 10/2007

(Continued)

OTHER PUBLICATIONS

International Alloy Designations and Chemical Composition Limits for Wrough Alumimun and Wrough Alluminum Alloys; Registration Record Series, Aluminum Association, Washington, DC; US; Jan. 1, 2004; pp. 1-26.

(Continued)

*Primary Examiner* — George Wyszomierski

*Assistant Examiner* — Janelle Morillo

(74) *Attorney, Agent, or Firm* — McBee Moore Woodward & Vanik IP, LLC; Susan E. Shaw McBee; David L. Vanik

(57) ABSTRACT

The present invention relates to extruded, rolled and/or forged products. Also provided are methods of making such products based on aluminum alloy wherein a liquid metal bath is prepared comprising 2.0 to 3.5% by weight of Cu, 1.4 to 1.8% by weight of Li, 0.1 to 0.5% by weight of Ag, 0.1 to 1.0% by weight of Mg, 0.05 to 0.18% by weight of Zr, 0.2 to 0.6% by weight of Mn and at least one element selected from Cr, Sc, Hf and Ti, the quantity of said element selected, being 0.05 to 0.3% by weight for Cr and for Sc, 0.05 to 0.5% by weight for Hf and 0.01 to 0.15% by weight for Ti, the remainder being aluminum and inevitable impurities. The products and methods of the present invention offer an advantageous compromise between static mechanical strength and damage tolerance and are useful in aeronautical design.

16 Claims, 9 Drawing Sheets

Related U.S. Application Data

(60) Provisional application No. 61/114,493, filed on Nov. 14, 2008.

(51) Int. Cl.
*C22C 21/16* (2006.01)
*C22F 1/04* (2006.01)

(58) Field of Classification Search
USPC ..... 148/690
See application file for complete search history.

(56) References Cited

U.S. PATENT DOCUMENTS

| | | | | |
|---|---|---|---|---|
| 5,455,003 | A | 10/1995 | Pickens et al. | |
| 7,229,509 | B2 | 6/2007 | Cho | |
| 8,323,426 | B2 * | 12/2012 | Danielou | C22C 21/12 148/502 |
| 2008/0289728 | A1 * | 11/2008 | Bes | C22C 21/16 148/552 |

FOREIGN PATENT DOCUMENTS

| | | | |
|---|---|---|---|
| RU | 2237098 | C1 | 9/2004 |
| WO | 9111540 | A1 | 8/1991 |
| WO | 9212269 | A1 | 7/1992 |
| WO | 2006131627 | A1 | 12/2006 |
| WO | 2007080267 | A1 | 7/2007 |

OTHER PUBLICATIONS

Balmuth et al.; "Fracture and Fatigue Crack Growth Resistance of Recrystallized Al—Li Alloys"; Materials Science Forum; Aedermannsfdorf; CH; vol. 217-222; No. 3; Jan. 1, 1996; pp. 1365-1370.

Colvin et al.; "The Use of X2096 as a Structural Die Forging Material"; Proceedings From Materials Solutions Conference; Nov. 5-8, 2001; Indianapolis, IN, ASM International; pp. 416-424.

2196-T8511 Al—Li Extrusions; ALCAN; pp. 1-2, Jun. 2007.

* cited by examiner

ALUMINUM-COPPER-LITHIUM PRODUCTS

CROSS REFERENCE TO RELATED APPLICATIONS

This application is a continuation application of U.S. patent application Ser. No. 12/617,803, filed Nov. 13, 2009, which claims priority to U.S. Provisional Application Ser. No. 61/114,493, filed Nov. 14, 2008; French Patent Application No. 08/06339, filed Nov. 14, 2008; and International Application No. PCT/FR2009/001299, filed Nov. 10, 2009, the contents of all of which are incorporated herein by reference in their entireties.

BACKGROUND OF THE INVENTION

Field of the Invention

The invention relates generally to welded aluminum-copper-lithium alloy products, and more specifically such products in the form of sections intended to produce stiffeners in aeronautical design.

Description of Related Art

Ongoing research is carried out to develop materials that can simultaneously reduce weight and increase the efficiency of high-performance aircraft structures. Aluminum alloys containing lithium are very beneficial in this respect, as lithium reduces the density of aluminum by 3% and increase the modulus of elasticity by 6% for each percent by weight of lithium added. In order for these alloys to be selected in aircrafts, the performance thereof must reach that of the alloys commonly used, particularly in terms of compromise between the static mechanical strength properties (yield stress, fracture strength) and damage tolerance properties (toughness, fatigue-induced crack propagation resistance), these properties being generally antinomic. Said alloys must also display a sufficient corrosion resistance, be able to be shaped using usual methods and display low residual stress so as to be able to be machined integrally.

U.S. Pat. No. 5,032,359 describes a large family of aluminum-copper-lithium alloys wherein the addition of magnesium and silver, particularly between 0.3 and 0.5 percent by weight, makes it possible to increase mechanical strength. Said alloys are frequently referred to using the brand name "Weldalite™".

U.S. Pat. No. 5,198,045 describes a family of Weldalite™ alloys comprising (as a % by weight) (2.4-3.5) Cu, (1.35-1.8) Li, (0.25-0.65) Mg, (0.25-0.65) Ag-(0.08-0.25) Zr. Welded products manufactured with said alloys combine a density less than 2.64 g/cm3 and a compromise between mechanical strength and advantageous toughness.

U.S. Pat. No. 7,229,509 describes a family of Weldalite™ comprising (as a % by weight) (2.5-5.5) Cu, (0.1-2.5) Li, (0.2-1.0) Mg, (0.2-0.8) Ag, (0.2-0.8) Mn—(up to 0.4) Zr or other refining agents such as Cr, Ti, Hf, Sc and V. Examples displayed exhibit an improved compromise between mechanical strength and toughness, but their density is higher than 2.7 g/cm3.

Published patent application WO2007/080267 describes a Weldalite™ alloy not containing zirconium intended for fuselage sheets (as a % by weight) (2.1-2.8) Cu, (1.1-1.7) Li, (0.2-0.6) Mg, (0.1-0.8) Ag, (0.2-0.6) Mn.

The patent EP1891247 describes a Weldalite™ alloy with a low alloy element content and also intended for the manufacture of fuselage sheets comprising (as a % by weight) (2.7-3.4) Cu, (0.8-1.4) Li, (0.2-0.6) Mg, (0.1-0.8) Ag and at least one element selected from Zr, Mn, Cr, Sc, Hf, Ti.

US Published Patent application WO2006/131627 describes an alloy intended to make fuselage plates comprising (wt. %) (2.7-3.4)Cu, (0.8-1.4) Li, (0.2-0.6) Mg, (0.1-0.8) Ag—and at least one element among Zr, Mn, Cr, Sc, Hf and Ti, wherein Cu and Li satisfy the condition Cu+5/3 Li<5,2.

U.S. Pat. No. 5,455,003 describes a method to make aluminum-copper-lithium alloys having improved mechanical strength and toughness at cryogenic temperature. This method applies notably to an alloy comprising (in wt. %) (2.0-6.5)Cu, (0.2-2.7) Li, (0-4.0) Mg, (0-4.0) Ag, (0-3.0) Zn.

Alloy AA2196 comprising (in wt. %) (2.5-3.3)Cu, (1.4-2.1) Li, (0.25-0.8) Mg, (0.25-0.6) Ag, (0.04-0.18) Zr and at most 0.35 Mn, is also known.

It was generally acknowledged in said patents or patent applications that severe homogenization, i.e. at a temperature of at least 527° C. and for a period of at least 24 hours would make it possible to achieve the optimal properties of the alloy. In some cases of alloys with low zirconium contents (EP1891247) or free from zirconium (WO2007/080267), much less severe homogenization conditions, i.e. a temperature below 510° C., were used.

However, there is still a need for Al—Cu—Li alloy products having a low density and further enhanced properties, particularly in terms of compromise between mechanical strength, on one hand, and damage tolerance, particularly toughness and fatigue-induced crack propagation resistance, on the other, while having other satisfactory usage properties, particularly corrosion resistance.

SUMMARY OF THE INVENTION

The present invention relates to a method to manufacture an extruded, rolled and/or forged product based on an aluminum alloy wherein:

a) a liquid metal bath is prepared comprising 2.0 to 3.5% by weight of Cu, 1.4 to 1.8% by weight of Li, 0.1 to 0.5% by weight of Ag, 0.1 to 1.0% by weight of Mg, 0.05 to 0.18% by weight of Zr, 0.2 to 0.6% by weight of Mn and at least one element selected from Cr, Sc, Hf and Ti, the quantity of said element, if it is selected, being 0.05 to 0.3% by weight for Cr and for Sc, 0.05 to 0.5% by weight for Hf and 0.01 to 0.15% by weight for Ti, the remainder being aluminum and inevitable impurities;

b) an unwrought shape is cast from said liquid metal bath;

c) said unwrought shape is homogenized at a temperature between 515° C. and 525° C. such that the equivalent time for homogenization $$t(eq) = \frac{\int \exp(-26100/T)dt}{\exp(-26100/T_{ref})}$$

is between 5 and 20 hours, where T (in Kelvin) is the instantaneous treatment temperature, which varies with the time t (in hours), and $T_{ref}$ is a reference temperature set at 793 K;

d) said unwrought shape is hot and optionally cold worked into an extruded, rolled and/or forged product;

e) the product is subjected to a solution treatment and quenched;

f) said product is stretched with a permanent set of 1 to 5% and preferentially at least 2%;

g) said product is aged artificially by heating at 140 to 170° C. for 5 to 70 hours such that said product has a yield strength measured at 0.2% elongation of at least 440 MPa and preferentially at least 460 MPa.

The present invention also relates to an extruded, rolled and/or forged aluminum alloy product having a density less than 2.67 g/cm3 capable of being obtained using a method according to the present invention.

The present invention also relates to a structural element incorporating at least one product according to the present invention.

DETAILED DESCRIPTION OF A PREFERRED EMBODIMENT

Figure 1:
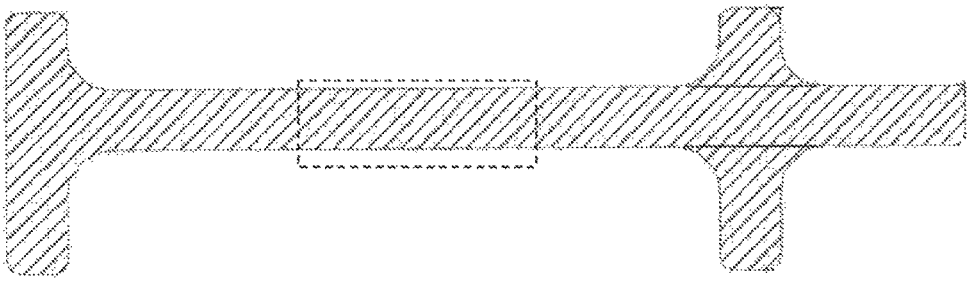
FIG. 1. Shape of W section according to example 1. The dimensions are given in mm. The samples used for the mechanical characterisations were taken in the zone indicated by the dotted line. The base thickness is 16 mm.

Unless specified otherwise, all the indications relating to the chemical composition of the alloys are expressed as a percentage by weight based on the total weight of the alloy. The alloys are named in accordance with the regulations of The Aluminum Association, known to those skilled in the art. The density depends on the composition and is determined by means of calculation rather than by means of a weight measurement method. The values are calculated in accordance with The Aluminum Association procedure, which is described on pages 2-12 and 2-13 of "Aluminum Standards and Data". The definitions of metallurgical tempers are given in the European standard EN 515.

Unless specified otherwise, the static mechanical properties, in other words the fracture strength Rm, the yield strength at 0.2% elongation Rp0.2 ("yield strength") and the elongation at fracture A, are determined by means of a tensile test as per EN 10002-1, the sampling and direction of the test being defined by the standard EN 485-1.

The stress intensity factor KQ is determined as per the standard ASTM E 399. Thus, specimen proportions as defined in paragraph 7.2.1 of this standard were always verified, as well as the general procedure defined in paragraph 8. The standard ASTM E 399 gives at paragraphs 9.1.3 and 9.1.4 criteria making it possible to determine whether KQ is a valid value of K1C. In this way, a K1C value is always a KQ value, the converse not being true. Within the scope of the present invention, criteria from paragraphs 9.1.3 and 9.1.4 of ASTM standard E399 are not always verified, however for a given specimen geometry KQ values can always be compared, the specimen geometry which enables a valid K1C measurement being not always obtainable given the constraints related to plates and extruded profiles dimensions.

The MASTMAASIS (Modified ASTM Acetic Acid Salt Intermittent Spray) test is performed as per the standard ASTM G85.

Unless specified otherwise, the definitions as per the standard EN 12258 apply. The section thickness is defined as per the standard EN 2066:2001: the cross-section is divided into elementary rectangles having the dimensions A and B; A always being the greater dimension of the elementary rectangle and B being able to be considered as the thickness of the elementary rectangle. The base is the elementary rectangle displaying the greatest dimension A.

The term "structural element" of a mechanical construction refers in this case to a mechanical part for which the static and/or dynamic mechanical properties are particularly important for the performance of the structure, and for which a structure calculation is usually specified or performed. They typically consist of elements wherein the failure is liable to endanger the safety of said constructions, the operators thereof, the users thereof or other parties. For an aircraft, said structural elements particularly comprise the elements forming the fuselages (such as the fuselage skin, stringers, bulkheads, circumferential frames, wings (such as the wing skin, stringers or stiffeners, ribs and spars) and the tail unit consisting of horizontal or vertical stabilisers, and floor beams, seat tracks and doors.

The present inventors observed that, surprisingly, for some low-density Al—Cu—Li alloys containing an addition of silver, magnesium, zirconium and manganese, the selection of specific homogenization conditions makes it possible to improve the compromise between the mechanical strength and damage tolerance very significantly.

The method according to the present invention makes it possible to manufacture an extruded, rolled and/or forged product.

In a first step, a liquid metal bath is prepared so as to obtain an aluminum alloy having a defined composition.

The copper content of the alloy for which the surprising effect associated with the selection of homogenization conditions is observed is advantageously from 2.0 to 3.5% by weight, preferentially from 2.45 or 2.5 to 3.3% by weight. In an advantageous embodiment, the copper content is from 2.7 to 3.1% by weight.

The lithium content is advantageously from 1.4 to 1.8% by weight. In an advantageous embodiment, the lithium content is from 1.42 to 1.77% by weight.

The silver content is preferably from 0.1 to 0.5% by weight. The present inventors observed that a large quantity of silver is typically not required to obtain the desired improvement in the compromise between the mechanical strength and the damage tolerance. In an advantageous embodiment of the invention, the silver content is from 0.15 to 0.35% by weight. In one embodiment of the present invention, which offers an advantage of minimising the density, the silver content is advantageously not more than 0.25% or about 0.25% by weight.

The magnesium content is preferably from 0.1 to 1.0% by weight and preferentially it is less than 0.4% by weight.

The combination of the specific homogenization conditions and the simultaneous addition of zirconium and manganese is an important feature to many aspects of the present invention. The zirconium content should advantageously be from 0.05 to 0.18% by weight and the manganese content is advantageously from 0.2 to 0.6% by weight. Preferentially, the manganese content is not more than 0.35% or about 0.35% by weight.

The alloy also advantageously contains at least one element that can help to control the grain size selected from Cr, Sc, Hf and Ti, the quantity of the element, if it is selected, being 0.05 to 0.3% by weight for Cr and for Sc, 0.05 to 0.5% by weight for Hf and 0.01 to 0.15% by weight for Ti.

It is preferable in some cases to limit the inevitable impurity content of the alloy in order to achieve the most favourable damage tolerance properties. The inevitable impurities comprise iron and silicon, said impurities preferentially having a content less than 0.08% by weight and 0.06% by weight for iron and silicon, respectively, the other impurities preferentially having a content less than 0.05% by weight each and 0.15% by weight in total. Moreover, the zinc content is preferentially less than 0.04% by weight.

Preferentially, the composition can be adjusted in some embodiments so as to obtain a density at ambient temperature less than 2.67 g/cm3, more preferentially less than 2.66 g/cm3 or in some cases less than 2.65 g/cm3 or even 2.64 g/cm3. Lower densities are in general associated to deteriorated properties. Within the scope of the present invention, it is surprisingly possible to combine a low density with a very advantageous mechanical properties compromise.

The liquid metal bath is then cast in an unwrought shape, such as a billet, a rolling plate or a rolling ingot or a forging blank.

The unwrought shape is then homogenized at a temperature between 515° C. and 525° C. such that the equivalent time t(eq) at 520° C. for the homogenization is between 5 and 20 hours and preferentially between 6 and 15 hours. The equivalent time t(eq) at 520° C. is defined by the formula:

$$t(eq) = \frac{\int \exp(-26100/T)dt}{\exp(-26100/T_{ref})}$$

where T (in Kelvin) is the instantaneous treatment temperature, which varies with the time t (in hours), and $T_{ref}$ is a reference temperature set at 793 K. t(eq) is expressed in hours. The constant Q/R=26100 K is derived from the Mn diffusion activation energy, Q=217000 J/mol. The formula giving t(eq) accounts for the heating and cooling phases. In the preferred embodiment of the invention, the homogenization temperature is approximately 520° C. and the treatment time is between 8 and 20 hours.

For the homogenization, the times specified correspond to periods for which the metal is actually at the required temperature.

It is shown in the examples that homgenizing conditions according to the present invention enable a surprising improvement of the compromise between toughness and mechanical strength, compared to conditions wherein the combination of temperature and time is lower or higher. It is generally known to one skilled in the art that, in order to minimize homogenizing time, it is advantageous to use the highest available temperature which enables diffusion of elements and dispersoid precipitation without incipient melting. To the contrary, the present inventors have observed that for an alloy according to the invention, there is provided a surprising favourable effect of a combination of homogenizing time and temperature lower than what was obtained according to the prior art.

After homogenization, the unwrought shape is generally cooled to ambient temperature before being preheated with a view to hot working. The purpose of preheating is to achieve a temperature preferentially between 400 and 500° C. and preferentially of the order of 450° C. enabling the working of the unwrought shape. The preheating is typically for 20 hours at 520° C. for ingots. It should be noted that, unlike homogenization, the times and temperatures specified for pre-heating correspond to the time spent in the furnace and to the temperature of the furnace and not to the temperature actually achieved by the metal and the time spent at said temperature. For billets intended to be extruded, induction preheating is advantageous.

Hot and optionally cold working is typically performed by means of extrusion, rolling and/or forging so as to obtain an extruded, rolled and/or forged product. The product obtained in this way is then subjected to a solution treatment preferentially by means of heat treatment between 490 and 530° C. for 15 min at 8 hours, and then quenched typically with water at ambient temperature or preferentially cold water.

The product then undergoes controlled stretching of 1 to 5% and preferentially at least 2%. In one embodiment of the invention, cold rolling is performed with a reduction between 5% and 15% before the controlled stretching step. Known steps such as flattening, straightening, shaping, may be optionally carried out before or after the controlled stretching.

Artificial aging is carried out at a temperature between 140 and 170° C. for 5 to 70 hours such that the product has a yield strength measured at 0.2% elongation of at least 440 MPa and preferentially at least 460 MPa. The present inventors observed that, surprisingly, the combination of the homogenization conditions according to the present invention with preferential artificial aging performed by means of heating at 148 to 155° C. for 10 to 40 hours makes it possible to achieve in some cases a particularly high level of toughness K1C(L-T).

In the view of the present inventors, products obtained by means of the method according to the invention display a very specific microstructure, although they have not yet been able to describe it precisely. In particular, the size, distribution and morphology of the dispersoids containing manganese appear to be remarkable for the products obtained by means of the method according to the present invention. However the complete characterisation of the dispersoids thereof, wherein the size of the order of 50 to 100 nm, requires quantified and numerous electron microscope observations at a magnification factor of 30,000, which explains the difficulty obtaining a reliable description.

Products according to the present invention have preferably a substantially un-recrystallized grain structure. By substantially un-recrystallized structure, it is meant that at least 80% and preferably at least 90% of the grains are not recrystallized at quarter and at half thickness of the product.

The extruded products and in particular the extruded sections obtained by means of the method according to the present invention are particularly advantageous. The advantages of the method according to the present invention were observed for thin sections wherein the thickness of at least one elementary rectangle is between 1 mm and 8 mm and thick sections; however, thick sections, i.e. wherein the thickness of at least one elementary rectangle is greater than 8 mm, and preferentially greater than 12 mm, or 15 mm, are the most advantageous in some cases. The compromise between the static mechanical strength and the toughness or fatigue strength is particularly advantageous for extruded products according to the present invention.

An extruded aluminum alloy product according to the present invention preferably has a density less than 2.67 g/cm3, is capable of being obtained by means of the method according to the invention, and is advantageously characterised in that:

(a) the yield strength measured at 0.2% elongation in the L direction Rp0.2(L) expressed in MPa and the toughness thereof K1C(L-T), in the L-T direction expressed in $MPa\sqrt{m}$ are such that KQ(L-T)>129−0.17 Rp0.2(L), preferentially KQ(L-T)>132−0.17 Rp0.2(L) and more preferentially KQ(L-T)>135−0.17 Rp0.2(L); and/or (b) the fracture strength thereof in the L direction Rm(L) expressed in MPa and the toughness thereof KQ(L-T), in the L-T direction expressed in $MPa\sqrt{m}$ are such that KQ(L-T)> 179−0.25 Rm(L), preferentially KQ(L-T)>182−0.25 Rm(L) and more preferentially KQ(L-T)>185−0.25 Rm(L); and/or (c) the fracture strength thereof in the TL direction Rm(TL) expressed in MPa and the toughness thereof KQ(L-T), in the L-T direction expressed in $MPa\sqrt{m}$ are such that KQ(L-T)>88−0.09 Rm(TL), preferentially KQ (L-T)>90−0.09 Rm(TL) and more preferentially KQ(L-T)>92−0.09 Rm(TL) and/or (d) the yield strength thereof measured at 0.2% elongation in the L direction Rp0.2(L) of at least 490 MPa and preferentially at least 500 MPa and the maximum fatigue-induced crack initiation stress for a number of fracture cycles of 105 is greater than 210 MPa, preferentially greater than 220 MPa and more preferentially than 230 MPa for test pieces having a Kt=2.3, where R=0.1.

Preferably, the toughness KQ(L-T) of extruded products according to the invention is at least 43 $MPa\sqrt{m}$.

In an advantageous embodiment, which enables to reach for extruded products a toughness KQ(L-T) of at least 52 $MPa\sqrt{m}$ with a yield strength of at least 490 MPa or preferably a toughness KQ(L-T) of at least 56 $MPa\sqrt{m}$ with a yield strength of at least 515 MPa, a copper content comprised between 2.45 and 2.65 wt. % is associated to a lithium content comprised between 1.4 and 1.5 wt. %.

In another advantageous embodiment, which enables to reach for extruded products a toughness KQ(L-T) of at least 45 $MPa\sqrt{m}$ with a yield strength of at least 520 MPa a copper content comprised between 2.65 and 2.85 wt. % is associated to a lithium content comprised between 1.5 and 1.7 wt. %.

Preferentially, the density of the extruded products according to the present invention is less than 2.66 g/cm3, more preferentially less than 2.65 g/cm3 or in some cases less than 2.64 g/cm3.

In an advantageous embodiment of the invention, artificial aging is performed making it possible to obtain a yield strength measured at 0.2% elongation greater than 520 MPa, for example for 30 hours at 152° C., the fracture strength in the L direction Rm(L), expressed in MPa and the toughness KQ(L-T), in the L-T direction expressed in $MPa\sqrt{m}$ are then such that Rm(L)>550 and KQ(L-T)>50.

The method according to the present invention also makes it possible to obtain advantageous rolled products. Of the rolled products, sheets wherein the thickness is at least 10 mm and preferentially at least 15 mm and/or at most 100 mm and preferentially at most 50 mm are advantageous.

A rolled aluminum alloy product according to the present invention advantageously has a density less than 2.67 g/cm3, is capable of being obtained by means of the method according to the present invention, and is advantageously characterised in that the toughness thereof KQ(L-T), in the L-T direction is at least 23 $MPa\sqrt{m}$ and preferentially at least 25 $MPa\sqrt{m}$, the yield strength measured at 0.2% elongation in the L direction Rp0.2(L) is at least equal to 560 MPa and preferentially at least equal to 570 MPa and/or the fracture strength in the L direction Rm(L) is at least equal to 585 MPa and preferentially at least equal to 595 MPa.

Preferentially, the density of the rolled products according to the present invention is less than 2.66 g/cm3, more preferentially less than 2.65 g/cm3 or in some cases less than 2.64 g/cm3.

The products according to the invention may advantageously be used in structural elements, particularly in aircraft. A structural element incorporating at least one product according to the invention or manufactured using such a product is advantageous, particularly for aeronautical design. A structural element, formed from at least one product according to the invention, particularly an extruded product according to the invention used as a stiffener or frame, may be used advantageously for the manufacture of fuselage panels or aircraft wings as in the case of any other use where the present properties may be advantageous.

In the assembly of structural parts, all suitable possible known riveting and welding techniques for aluminum alloys may be used, if required. The inventors found that if welding is selected, it may be preferable to use laser welding or friction-mixing welding techniques.

The products according to the present invention generally do not give rise to any particular problem during subsequent surface treatment operations conventionally used in aeronautical design.

The corrosion resistance of the products according to the present invention is generally high; for example, the result in the MASTMAASIS test is at least EA and preferentially P for the products according to the invention.

These aspects, along with others of the present invention are explained in more detail using the illustrative and non-limiting examples below.

EXAMPLES

Example 1

In this example, several ingots made of Al—Cu—Li alloy wherein the composition is given table 1 were cast.

TABLE 1

Composition as a % by weight and density of Al—Cu—Li alloys

| Alloy | Si | Fe | Cu | Mn | Mg | Zn | Ti | Zr | Li | Ag | Density (g/cm$^{>>}$) |
|---|---|---|---|---|---|---|---|---|---|---|---|
| 1 | 0.06 | 0.04 | 2.94 | 0.01 | 0.36 | 0.01 | 0.02 | 0.12 | 1.62 | 0.34 | 2.635 |
| 2 | 0.04 | 0.05 | 2.83 | 0.33 | 0.36 | 0.02 | 0.02 | 0.11 | 1.59 | 0.38 | 2.641 |

The ingots were homogenized according to the prior art for 8 hours at 500° C. and 24 hours at 527° C. Billets were sampled in the ingot. The billets were heated at 450° C.+/−40° C. and subject to hot extrusion to obtain W sections according to FIG. 1. The sections obtained in this were subjected to a solution treatment at 524° C., quenched with water at a temperature less than 40° C., and stretched with a permanent elongation between 2 and 5%. The artificial aging was performed for 48 hours at 152° C. Samples taken at the end of sections were tested to determine the static mechanical properties thereof (yield stress $R_{p0.2}$, fracture strength $R_m$, and elongation at fracture (A), sample diameter: 10 mm) and the toughness (KQ) thereof. The sampling location is shown with a dotted line in FIG. 1. The specimen used for toughness measurement had the following dimensions: B=15 mm and W=30 mm.

A temperature rise rate of 15° C./hour and 50° C./hour were used for the homogenization and solution treatment, respectively. The equivalent time for homogenization was 37.5 hours.

The results obtained are given in table 2 below.

TABLE 2

Mechanical properties of sections obtained from alloys 1 and 2.

| | L direction | | | LT direction | | | $K_Q$ ($K_{1C}$) | |
|---|---|---|---|---|---|---|---|---|
| | $R_m$ | $R_{p0.2}$ | A | $R_m$ | $R_{p0.2}$ | A | (MPa $\sqrt{m}$) | |
| Alloy | (MPa) | (MPa) | (%) | (MPa) | (MPa) | (%) | L-T | T-L |
| 1 | 571 | 533 | 8.7 | 560 | 508 | 10.4 | 28.5 | 29.0 |
| 2 | 556 | 522 | 7.9 | 550 | 515 | 8.4 | 37.6 | 35.5 |

Example 2

In this example, three homogenization conditions were compared for two types of sections, obtained using billets sampled in a sheet wherein the composition is given in table 3 below.

TABLE 3

Composition as a % by weight and density of Al—Cu—Li alloy used.

| Alloy | Si | Fe | Cu | Mn | Mg | Zn | Ti | Zr | Li | Ag | Density (g/cm$^3$) |
|---|---|---|---|---|---|---|---|---|---|---|---|
| 3 | 0.03 | 0.04 | 2.72 | 0.31 | 0.31 | 0.02 | 0.03 | 0.10 | 1.61 | 0.34 | 2.637 |

Figure 2:
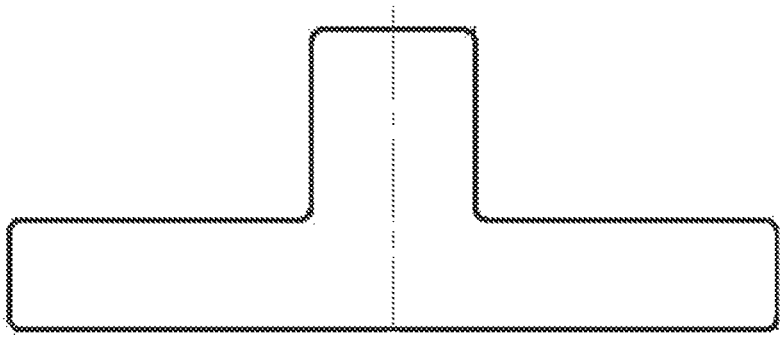
FIG. 2. Shape of X section according to example 2. The dimensions are given in mm. The base thickness is 26.3 mm.

The billets were homogenized either for 8 hours at 500° C. followed by 24 hours at 527° C. (reference A) or for 8 hours at 520° C. (reference B) or for 8 hours at 500° C. (reference C). The temperature rise rate was 15° C./hour for the homogenization and the equivalent time was 37.5 hours for the homogenization of reference A, 9.5 hours for the homogenization of reference B, and 4 hours for the homogenization of reference C. After homogenization, the billets were heated at 450° C.+/−40° C. and subjected to hot extrusion to obtain X sections according to FIG. 2 or Y sections according to FIG. 3. The sections obtained in this way were subjected to a solution treatment at 524+/−2° C., quenched with water at a temperature less than 40° C., and stretched with a permanent elongation between 2 and 5%.

Figure 3:
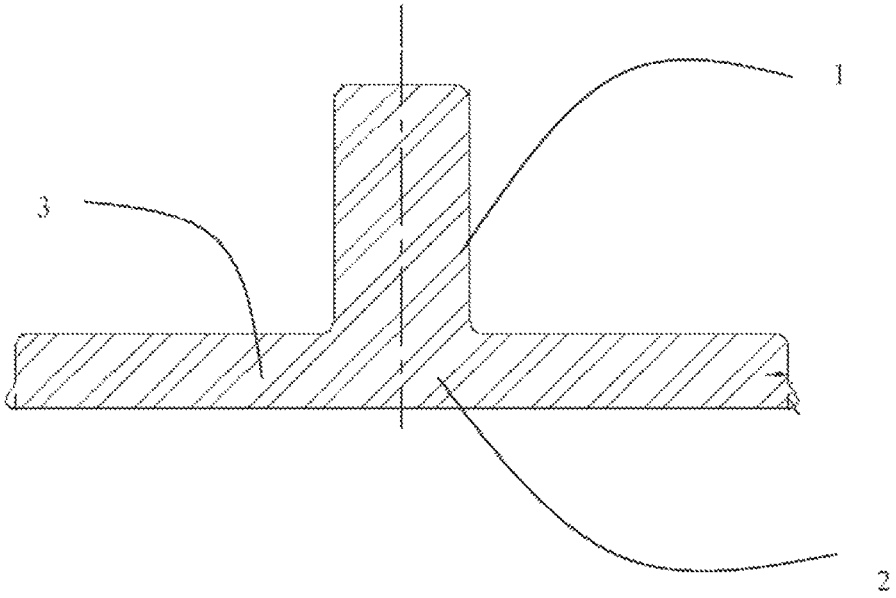
FIG. 3. Shape of Y section according to example 2. The dimensions are given in mm. The base thickness is 18 mm.

Various artificial aging conditions were used. Samples taken at the end of sections were tested to determine the static mechanical properties thereof (yield stress Rp0.2, fracture strength Rm, and elongation at fracture (A) along with the toughness (KQ) thereof. The sampling zones for the Y section are indicated in FIG. 3: reinforcement (1), reinforcement/base (2), base (3), the specimen used for toughness measurement had the following dimensions: B=15 mm and W=60 mm. For the X section, the samples are taken on the base, the specimen used for toughness measurement had the following dimensions: B=20 mm and W=76 mm. The samples taken had a diameter of 10 mm except for the T-L direction for which the samples had a diameter of 6 mm.

The results obtained on the X sections are given in table 4 below.

TABLE 4

Mechanical properties of X sections made of alloy 3.

| Artificial aging | Homogenization | L direction $R_m$ (MPa) | L direction $R_{p0.2}$ (MPa) | L direction A (%) | TL direction $R_m$ (MPa) | TL direction $R_{p0.2}$ (MPa) | TL direction A (%) | KQ (MPa $\sqrt{m}$) L-T | KQ (MPa $\sqrt{m}$) T-L |
|---|---|---|---|---|---|---|---|---|---|
| 48 hrs 152° C. | A | 563 | 533 | 8.4 | 512 | 484 | 5.4 | 39.1 | 30.9 |
| | B | 569 | 541 | 9.8 | 528 | 500 | 6.6 | 40.7 | 34.2 |
| | C | 565 | 537 | 7.7 | 507 | 477 | 6.7 | 37.7 | 28.9 |
| 30 hrs 152° C. | A | 554 | 522 | 8.8 | 500 | 470 | 5.2 | 42.5 | 34.1 |
| | B | 557 | 524 | 10.1 | 519 | 486 | 7.4 | 53.3 | 42.9 |
| | C | 553 | 520 | 8.0 | 494 | 457 | 7.4 | 40.7 | 32.9 |
| 23 hrs 145° C. | A | 512 | 452 | 9.3 | 448 | 390 | 6.7 | 47.2 | 43.8 |
| | B | 515 | 455 | 10.0 | 479 | 414 | 12.6 | 47.1 | 58.9 |
| | C | 513 | 454 | 8.3 | 445 | 377 | 9.0 | 45.6 | 43.2 |

Figure 4A:
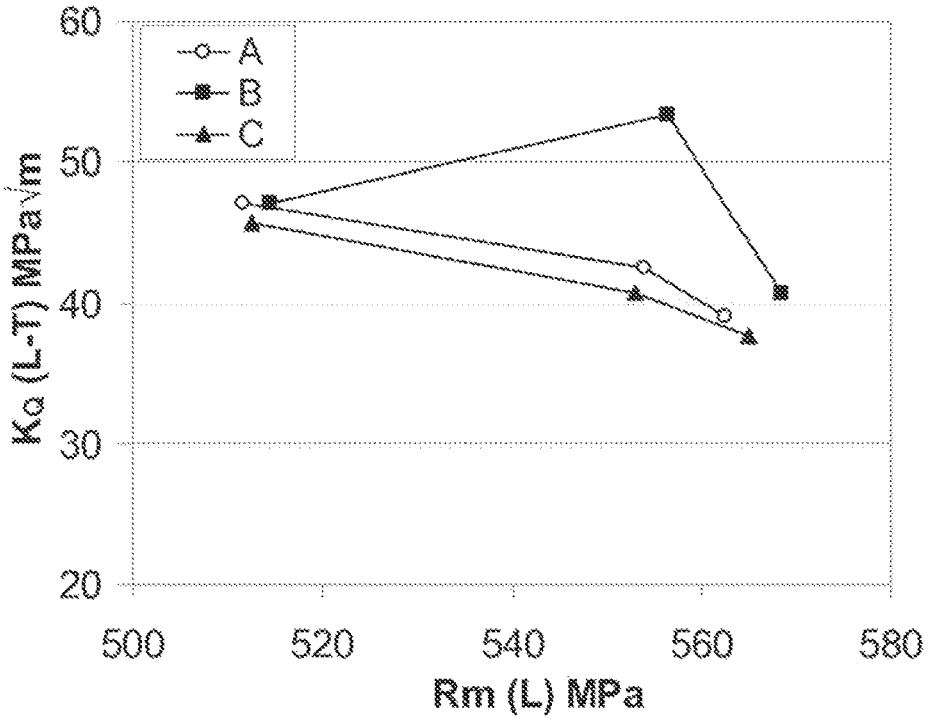
FIGS. 4A and 4B. Compromise between toughness and mechanical strength obtained for the X sections according to example 2.
Figure 4B:
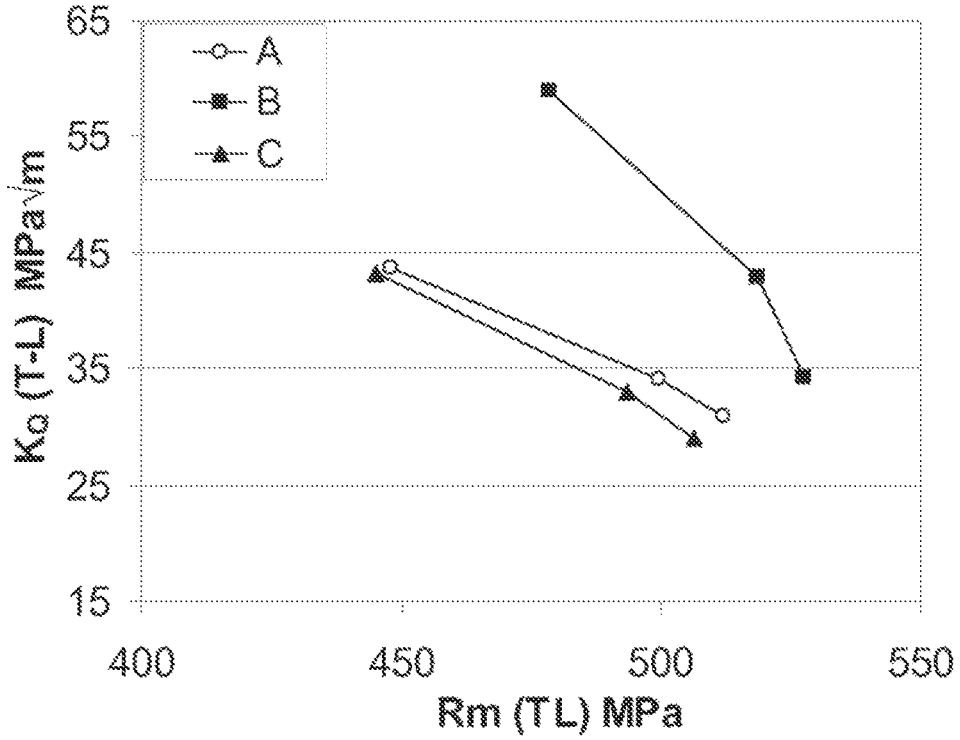

These results are illustrated by FIGS. 4A (L direction) and 4B (TL direction). For sections obtained from billets that have been homogenized at 520° C., the compromise between mechanical strength and toughness is enhanced very significantly. In the longitudinal direction, the improvement is particularly marked for artificial aging for 30 hours at 152° C.

The results obtained with the Y section are given in table 5 below.

TABLE 5

Mechanical properties of Y sections made of alloy 3.

| Homogenization | | Artificial aging 30 hrs 152° C. A | 30 hrs 152° C. B | 48 hrs 152° C. A | 48 hrs 152° C. B |
|---|---|---|---|---|---|
| L direction - Reinforcements | $R_m$ (MPa) | 527 | 563 | 538 | 573 |
| | $R_{p0.2}$ (MPa) | 500 | 537 | 516 | 551 |
| | A (%) | 7.5 | 9.9 | 8.1 | 9.6 |
| L direction - Reinforcement/base | $R_m$ (MPa) | 534 | 580 | 551 | 590 |
| | $R_{p0.2}$ (MPa) | 510 | 559 | 534 | 572 |
| | A (%) | 6.6 | 8.6 | 7 | 7.8 |
| L direction - Base | $R_m$ (MPa) | 543 | 536 | 557 | 549 |
| | $R_{p0.2}$ (MPa) | 505 | 494 | 529 | 517 |
| | A (%) | 7.3 | 9.2 | 7.2 | 9.5 |
| T-L direction (base) | $R_m$ (MPa) | 501 | 488 | 513 | 503 |
| | $R_{p0.2}$ (MPa) | 456 | 441 | 472 | 462 |
| | A (%) | 8.8 | 12.3 | 8.6 | 11.4 |
| $K_Q$ (CT15 – W60) (MPa $\sqrt{m}$) | L-T | 34.3 | 45.2 | 30.5 | 42.8 |
| | T-L | 29.3 | 42.5 | 26.4* | 37.3 |

*$K_{1C}$

Figure 5A:
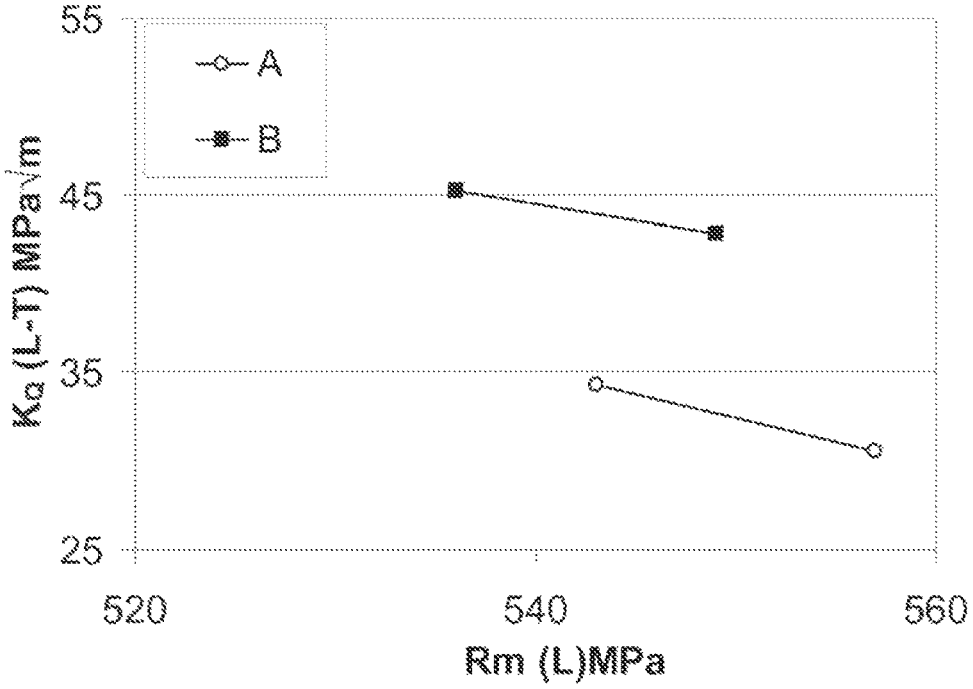
FIGS. 5A and 5B. Compromise between toughness and mechanical strength obtained for the Y sections according to example 2; 5A: base and longitudinal direction; 5B: base and long transverse direction.
Figure 5B:
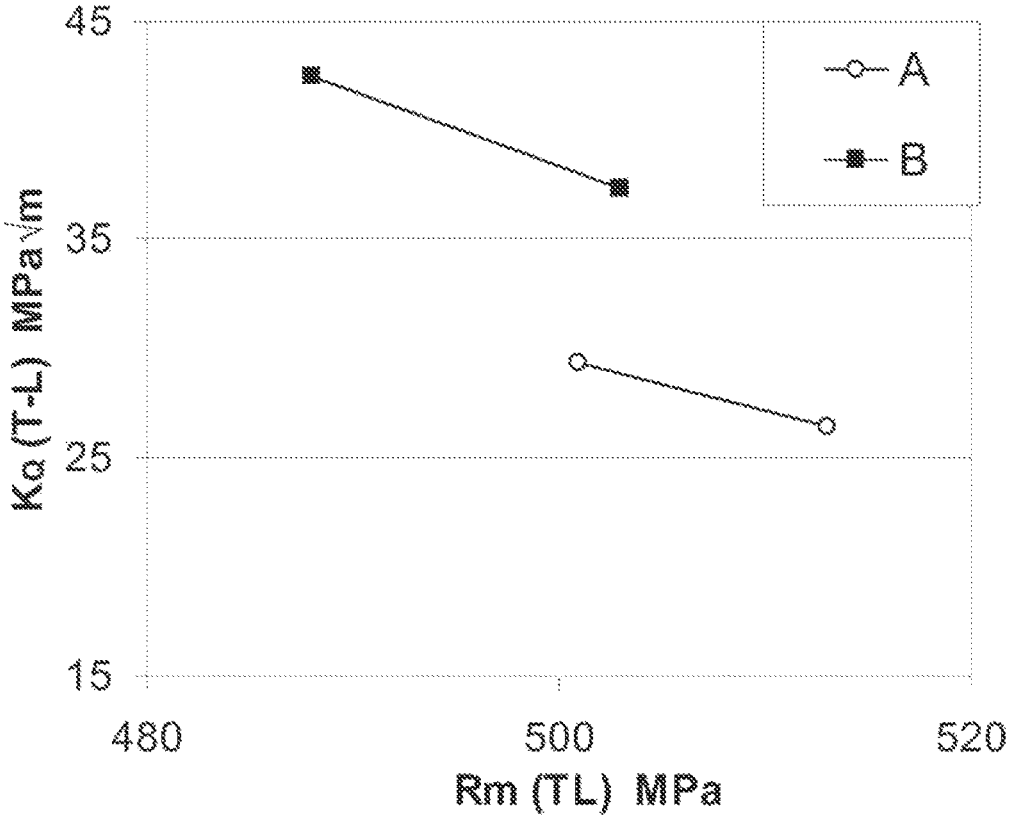

These results are illustrated by FIGS. 5A (L direction) and 5B (TL direction). For sections obtained from billets that have been homogenized at 520° C., the compromise between mechanical strength and toughness is again enhanced very significantly, for both artificial aging conditions tested.

Figure 6:
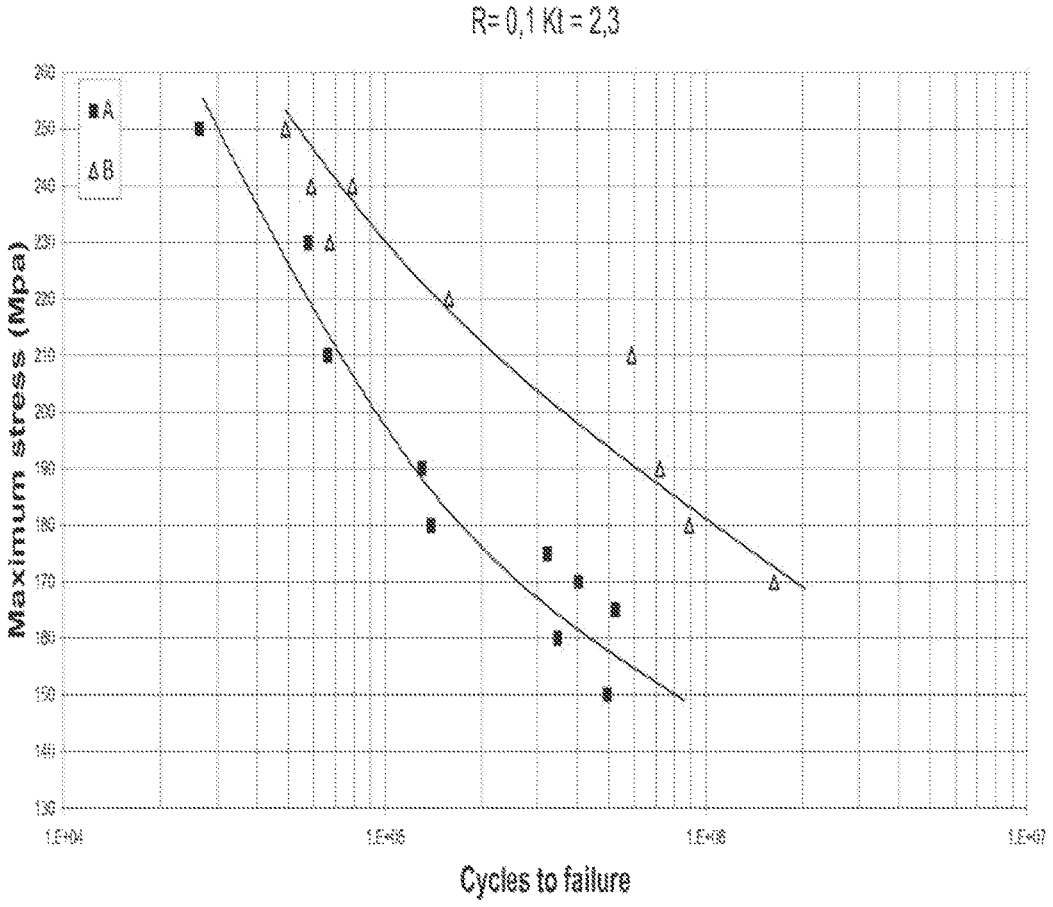
FIG. 6. Wohler crack initiation curve for Y sections according to example 2.

Fatigue tests were performed in the case of artificial aging for 30 hrs at 152° C., on test pieces with holes (Kt=2.3) with (minimum load/maximum load) ratio R=0.1 at a frequency of 80 Hz. The tests were carried out in the ambient air of the laboratory. These tests are given in FIG. 6. For a given number of cycles, the increase in the maximum stress is between 10 and 25%. The maximum stress for fatigue-induced crack initiation for a number of cycles at fracture of 105 is of the order of 230 MPa for tests specimens of Kt=2.3, where R=0.1.

Example 3

In this example, two of the homogenization conditions in example 2 were compared for another type of section, obtained from billets taken in an ingot wherein the composition is given in table 6 below:

TABLE 6

Composition as a % by weight of Al—Cu—Li alloys used

| Alloy | Si | Fe | Cu | Mn | Mg | Zn | Ti | Zr | Li | Ag | Density (g/cm$^3$) |
|---|---|---|---|---|---|---|---|---|---|---|---|
| 4 | 0.03 | 0.05 | 3.05 | 0.01 | 0.39 | 0.01 | 0.03 | 0.12 | 1.70 | 0.35 | 2.631 |
| 5 | 0.03 | 0.04 | 2.90 | 0.31 | 0.40 | 0.01 | 0.03 | 0.1 | 1.67 | 0.38 | 2.635 |

Figure 7:
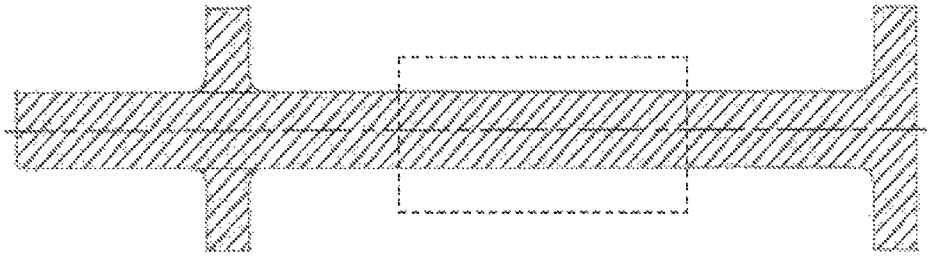
FIG. 7. Shape of Z section according to example 3. The dimensions are given in mm. The samples used for the mechanical characterisations were taken in the zone indicated by the dotted line. The base thickness is 20 mm.

The billets made of alloy 4 were homogenized for 8 hrs at 500° C. followed by 24 hrs at 527° C. (i.e. the homogenization of reference A) whereas the billets made of alloy 5 were homogenized for 8 hrs at 520° C. (reference B). After homogenization, the billets were heated at 450° C.+/−40° C. and subjected to hot extrusion to obtain the Z section according to FIG. 7. The sections obtained in this way were subjected to a solution treatment at 524+/−2° C., quenched with water at a temperature less than 40° C., and stretched with a permanent elongation between 2 and 5%. The sections then underwent artificial aging for 48 hrs at 152° C. Samples taken at the end of sections were tested to determine the static mechanical properties thereof (yield stress $R_{p0.2}$, fracture strength $R_m$, and elongation at fracture (A), sample diameter: 10 mm) along with the toughness thereof (KQ), the specimen used for toughness measurement had the following dimensions: B=15 mm and W=60 mm. The measurements made at the end of a section generally make it possible to obtain the least favourable mechanical properties of the section. The location of the samples is given by means of a dotted line in FIG. 7.

The results obtained are given in table 7 below. The products according to the invention display slightly superior mechanical properties and toughness improved by more than 20%.

TABLE 7

Mechanical properties of Z sections made of alloy 4 and 5.

| | L direction | | | KQ (MPa $\sqrt{m}$) | |
|---|---|---|---|---|---|
| Alloy | $R_m$ (MPa) | $R_{p0.2}$ (MPa) | A (%) | L-T | T-L |
| 4 | 576 | 527 | 8.4 | 31.0 | 31.4 |
| 5 | 574 | 536 | 9.8 | 38.2 | 37.8 |

Example 4

In this example, a billet wherein the composition is given in table 8 was cast.

TABLE 8

Composition as a % by weight and density of Al—Cu—Li alloy used.

| Alloy | Si | Fe | Cu | Mn | Mg | Zn | Ti | Zr | Li | Ag | Density (g/cm$^3$) |
|---|---|---|---|---|---|---|---|---|---|---|---|
| 6 | 0.03 | 0.05 | 3.1 | 0.3 | 0.4 | 0.01 | 0.03 | 0.11 | 1.65 | 0.34 | 2.639 |

Figure 8:
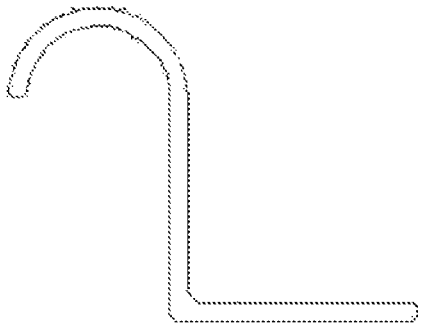
FIG. 8. Shape of P section according to example 4. The dimensions are given in mm.

The billets made of alloy 6 were homogenized for 8 hours at 520° C. (i.e. the homogenization of reference B). After homogenization, the billets were heated at 450° C.+/−40° C. and subjected to hot extrusion to obtain P sections according to FIG. 8. The sections obtained in this way were subjected to a solution treatment, quenched with water at a temperature less than 40° C., and stretched with a permanent elongation between 2 and 5%. The sections then underwent artificial aging for 48 hours at 152° C. Samples taken at the end of sections were tested to determine the static mechanical properties thereof (yield stress $R_{p0.2}$, the fracture strength $R_m$, and the elongation at fracture A).

The results obtained are given in table 9 below.

TABLE 9

Mechanical properties of P sections made of alloy 6.

| | L direction | | |
|---|---|---|---|
| Alloy | $R_m$ (MPa) | $R_{p0.2}$ (MPa) | A (%) |
| 6 | 562 | 525 | 10.1 |

Fatigue tests were carried in, on test pieces with holes (Kt=2.3) with a (minimum load/maximum load) ratio R=0.1 at a frequency of 80 Hz. The tests were conducted in the ambient air of the laboratory. The results of these tests are given in table 10.

TABLE 10

| Results of S/N fatigue tests for sections made of alloy 6 | |
|---|---|
| Maximum load [MPa] MPa | Cycles N |
| 300 | 22,120 |
| 280 | 31,287 |
| 260 | 46,696 |
| 240 | 53,462 |
| 220 | 87,648 |
| 200 | 113,583 |
| 180 | 132,003 |
| 170 | 203,112 |
| 160 | 232,743 |
| 150 | 177,733 |

TABLE 10-continued

| Results of S/N fatigue tests for sections made of alloy 6 | |
|---|---|
| Maximum load [MPa] MPa | Cycles N |
| 140 | 5,113,237 |
| 130 | 9,338,654 |

Example 5

In this example, a billet wherein the composition is given in table 11 was cast.

TABLE 11

| Composition as a % by weight and density of Al—Cu—Li alloy used. | | | | | | | | | | | |
|---|---|---|---|---|---|---|---|---|---|---|---|
| Alloy | Si | Fe | Cu | Mn | Mg | Zn | Ti | Zr | Li | Ag | Density ($g/cm^3$) |
| 7 | 0.03 | 0.05 | 3.1 | 0.3 | 0.4 | 0.01 | 0.04 | 0.10 | 1.71 | 0.36 | 2.636 |

Figure 9:
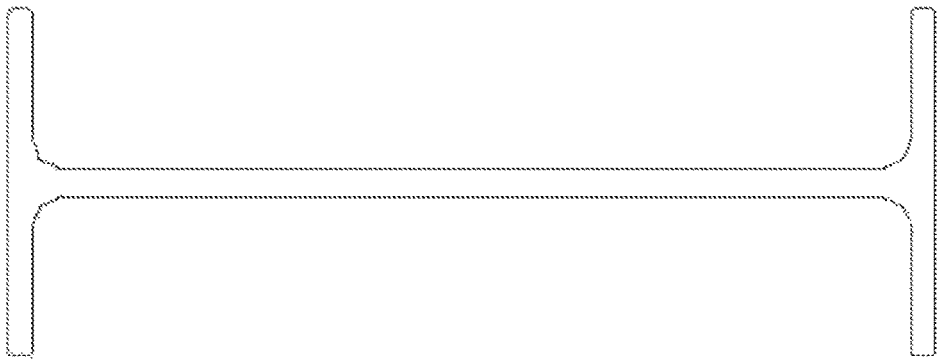
FIG. 9. Shape of Q section according to example 5. The dimensions are given in mm.

The billets made of alloy 7 were homogenized for 8 hours at 520° C. (i.e. the homogenization of reference B). After homogenization, the billets were heated at 450° C.+/−40° C. and subjected to hot extrusion to obtain Q sections according to FIG. 9. The sections obtained in this way were subjected to a solution treatment, quenched with water at a temperature less than 40° C., and stretched with a permanent elongation between 2 and 5%. The sections finally underwent artificial aging for 48 hours at 152° C. Samples taken at the end of sections were tested to determine the static mechanical properties thereof (yield stress Rp0.2, fracture strength Rm, and elongation at fracture A).

The results obtained are given in table 12 below.

TABLE 12

| Mechanical properties of Q sections made of alloy 7. | | | |
|---|---|---|---|
| | L direction | | |
| Alloy | $R_m$ (MPa) | $R_{p0.2}$ (MPa) | A (%) |
| 7 | 561 | 521 | 8.5 |

Fatigue tests were carried out in, on test pieces with holes (Kt=2.3) with a (minimum load/maximum load) ratio R=0.1 at a frequency of 80 Hz. The tests were carried out in the ambient air of the laboratory. The results of these tests are given in table 13.

TABLE 13

Results of S/N fatigue tests for sections made of alloy 7.

| Maximum load [MPa] MPa | Cycles N |
|---|---|
| 300 | 22,165 |
| 280 | 32,214 |
| 260 | 47,536 |
| 240 | 59,094 |
| 220 | 103,407 |
| 200 | 251,771 |
| 190 | 254,842 |
| 180 | 6,508,197 |

TABLE 13-continued

Results of S/N fatigue tests for sections made of alloy 7.

| Maximum load [MPa] MPa | Cycles N |
|---|---|
| 160 | 6,130,947 |
| 130 | 9,383,980 |

Example 6

In this example, a sheet wherein the composition is given in table 14 was cast.

TABLE 14

Composition as a % by weight of the Al—Cu—Li alloy used.

| Alloy | Si | Fe | Cu | Mn | Mg | Zn | Ti | Zr | Li | Ag | Density ($g/cm^3$) |
|---|---|---|---|---|---|---|---|---|---|---|---|
| 8 | 0.03 | 0.06 | 3.1 | 0.3 | 0.4 | 0.01 | 0.03 | 0.11 | 1.77 | 0.36 | 2.631 |

The ingot was scalped and homogenized at 520+/−5° C. for 8 hours (i.e. the homogenization of reference B). After homogenization, the sheet was hot-rolled to obtain ingots having a thickness of 25 mm. The ingots were subjected to a solution treatment at 524+/−2° C., quenched with cold water and stretched with a permanent elongation between 2 and 5%. Samples 10 mm in diameter taken in some of said sheets then underwent artificial aging for a time between 20 hours and 50 hours at 155° C. Said samples were tested to determine the static mechanical properties thereof (yield stress Rp0.2, the fracture strength Rm, and the elongation at fracture (A)) along with the toughness (KQ) thereof, with specimen having B=15 mm and W=30 mm. The results obtained are given in table 15 below.

TABLE 15

Mechanical properties of sheets made of alloy 8 having undergone artificial aging in the laboratory.

| Alloy | Stretching | Artificial aging time at 155° C. | $R_m$ L (MPa) | $R_{p0.2}$ L (MPa) | KQ L-T (MPa $\sqrt{m}$) |
|---|---|---|---|---|---|
| 8 | 2.5% | 20 | 557 | 504 | 33.9 |
| | | 30 | 579 | 538 | 28.6 |
| | | 40 | 586 | 550 | 25.4 |
| | | 50 | 589 | 555 | 25.8* |
| 8 | 4.4% | 20 | 577 | 543 | 30.5 |
| | | 30 | 589 | 562 | 27.2 |
| | | 40 | 594 | 566 | 23.8* |
| | | 50 | 597 | 571 | 23.7 |

*$K_{1C}$

The sheets underwent industrial artificial aging for 48 hours at 152° C. The results of the mechanical tests (sampling at mid-height) performed on the sheets obtained in this way are given in table 16.

TABLE 16

Mechanical properties of sheets made of alloy 8 having undergone industrial artificial aging

| Stretching | $R_m$ L (MPa) | $Rp_{0.2}$ L (MPa) | A % L | $R_m$ TL (MPa) | $R_{p0.2}$ TL (MPa) | A % TL | $R_m$ 45° (MPa) | $R_{p0.2}$ 45° (MPa) | A % 45° | $K_Q$ L-T (MPa $\sqrt{m}$) | $K_Q$ T-L (MPa $\sqrt{m}$) |
|---|---|---|---|---|---|---|---|---|---|---|---|
| 2.5 | 594 | 559 | 6 | 568 | 523 | 6 | 522 | 466 | 9 | 26.2 | 25.1 |
| 4 | 600 | 571 | 6 | 575 | 537 | 6 | 526 | 476 | 10 | 25.3 | 24.7 |

Example 7

In this example, homogenization conditions according to the invention were compared for two types of sections, obtained using billets made of two different alloys, the composition thereof being given in table 17 below.

TABLE 7

Composition as a % by weight and density of Al—Cu—Li alloy used.

| Alloy | Si | Fe | Cu | Mn | Mg | Zn | Ti | Zr | Li | Ag | Density ($g/cm^3$) |
|---|---|---|---|---|---|---|---|---|---|---|---|
| 9 | 0.03 | 0.05 | 2.49 | 0.31 | 0.35 | 0.01 | 0.04 | 0.13 | 1.43 | 0.25 | 2.645 |
| 10 | 0.03 | 0.06 | 2.62 | 0.30 | 0.35 | 0.01 | 0.04 | 0.14 | 1.42 | 0.25 | 2.648 |

The billets were homogenized for 8 hours at 520° C. (reference B). The temperature rise rate was 15° C./hour for the homogenization and the equivalent time was 9.5 hours. After homogenization, the billets were heated at 450° C.+/−40° C. and subjected to hot extrusion to obtain X sections according to FIG. 2 or Y sections according to FIG. 3. The sections obtained in this way were subjected to a solution treatment at 524+/−2° C., quenched with water at a temperature less than 40° C., and stretched with a permanent elongation between 2 and 5%.

Various artificial aging conditions were used. Samples taken at the end of sections were tested to determine the static mechanical properties thereof (yield stress Rp0.2, fracture strength Rm, and elongation at fracture (A) along with the toughness (KQ) thereof. The sampling zones for the Y section are indicated in FIG. 3: reinforcement (1), reinforcement/base (2), base (3), the specimen used for toughness measurement had the following dimensions: B=15 mm and W=60 mm. For the X section, the samples are taken on the base, the specimen used for toughness measurement had the following dimensions: B=20 mm and W=76 mm. The samples taken had a diameter of 10 mm except for the T-L direction for which the samples had a diameter of 6 mm.

The results obtained on the X and Y sections are given in tables 18 and 19 below.

TABLE 18

Mechanical properties of X sections made of alloys 8 and 9.

| | | L direction | | | TL direction | | | KQ | |
|---|---|---|---|---|---|---|---|---|---|
| | Artificial | $R_m$ | $R_{p0.2}$ | A | $R_m$ | $R_{p0.2}$ | A | (MPa $\sqrt{m}$) | |
| Alloy | aging | (MPa) | (MPa) | (%) | (MPa) | (MPa) | (%) | L-T | T-L |
| 9 | 20 H 152° C. | 468 | 405 | 12.6 | 444 | 388 | 15.1 | 60.8 | 60.2 |
| | 30 H 152° C. | 497 | 450 | 12.8 | 465 | 417 | 14.1 | 63.7 | 52.1 |
| | 48 H 152° C. | 517 | 478 | 11.0 | 486 | 447 | 12.5 | 60.3 | 47.9* |
| | 60 H 152° C. | 526 | 493 | 10.9 | 494 | 458 | 12.7 | 56.5 | 45.6* |
| 10 | 20 H 152° C. | 488 | 433 | 10.9 | 457 | 397 | 13.1 | 61.4 | 54.1 |
| | 30 H 152° C. | 513 | 470 | 11.3 | 486 | 441 | 13.2 | 59.8 | 47.7 |
| | 48 H 152° C. | 532 | 498 | 10.1 | 501 | 463 | 12.4 | 55.2 | 42.5* |
| | 60 H 152° C. | 536 | 503 | 9.9 | 503 | 468 | 9.5 | 53.6 | 40.0* |

*$K_{1C}$

TABLE 19

Mechanical properties of Y sections made of alloys 8 and 9.

| | | L direction | | | TL direction | | | KQ | |
|---|---|---|---|---|---|---|---|---|---|
| | Artificial | $R_m$ | $R_{p0.2}$ | A | $R_m$ | $R_{p0.2}$ | A | (MPa $\sqrt{m}$) | |
| Alloy | aging | (MPa) | (MPa) | (%) | (MPa) | (MPa) | (%) | L-T | T-L |
| 9 | 20 H 152° C. | 489 | 432 | 12 | 451 | 392 | 15 | 53.6 | 53.6 |
| | 30 H 152° C. | 517 | 477 | 11 | 478 | 435 | 13 | 57.9 | 50.8 |
| | 48 H 152° C. | 535 | 501 | 10 | 494 | 457 | 12 | 56.9 | 47.2 |
| | 60 H 152° C. | 539 | 506 | 10 | 497 | 462 | 12 | 53.0 | 45.4* |
| 10 | 20 H 152° C. | 496 | 440 | 11.9 | 458 | 402 | 14 | 54.2 | 50.3 |
| | 30 H 152° C. | 523 | 483 | 11.1 | 485 | 442 | 13 | 52.7 | 46.3 |
| | 48 H 152° C. | 539 | 506 | 10.5 | 500 | 465 | 11 | 52.2 | 39.5 |
| | 60 H 152° C. | 546 | 515 | 10.3 | 504 | 470 | 11 | 49.1 | 38.4* |

*$K_{1C}$

The compromise between toughness and mechanical strength obtained with alloys 8 and 9 is particularly advantageous, in particular to obtain very high toughness with $K_Q$(L-T) higher than 50 MPa$\sqrt{m}$, and even higher than 55 MPa$\sqrt{m}$.

The content of all documents mentioned herein are incorporated by reference in their entireties to the extent mentioned. As used herein and in the following claims, articles can connote the singular or plural of the term which follows. The invention has been described in terms of a preferred embodiment and equivalent methods and products in as much as they represent embodiments that are insubstantially changed from what is described, are also covered as well.

The invention claimed is:

1. A method of manufacturing an extruded product based on an aluminum alloy, said method comprising:

a) preparing a liquid metal bath consisting essentially of 2.72 to 3.1% by weight of Cu, 1.59 to 1.8% by weight of Li, 0.1 to 0.5% by weight of Ag, 0.1 to 1.0% by weight of Mg, 0.05 to 0.18% by weight of Zr, 0.2 to 0.6% by weight of Mn, and at least one element selected from Cr, Sc, Hf and Ti, the quantity of said element, if included, being 0.05 to 0.3% by weight for Cr and for Sc, 0.05 to 0.5% by weight for Hf or 0.01 to 0.15% by weight for Ti, remainder aluminum and inevitable impurities;

b) casting an unwrought shape from said liquid metal bath;

c) homogenizing said unwrought shape at a temperature from 515° C. to 525° C. such that the equivalent time for homogenization $$t(eq) = \frac{\int \exp(-26100/T)dt}{\exp(-26100/T_{ref})}$$

is from 5 to 20 hours, where T (in Kelvin) is the instantaneous treatment temperature, which varies with the time t (in hours), and $T_{ref}$ is a reference temperature set at 793 K;

d) hot working and optionally cold working said unwrought shape into an extruded product;

e) subjecting the product to a solution treatment and quenching;

f) stretching said product with a permanent set of 1 to 5%; and g) artificially aging said product by heating at 140 to 170° C. for 5 to 70 hours such that said product has a yield strength measured at 0.2% elongation in the L-direction of at least 517 MPa.

2. The method according claim 1, wherein the silver content of said liquid metal bath is from 0.15 to 0.35% by weight.

3. The method according to claim 1 wherein the magnesium content of said liquid metal bath is less than 0.4% by weight.

4. The method according to claim 1 wherein the manganese of said liquid metal bath is not more than 0.35% by weight.

5. The method according to claim 1 wherein said inevitable impurities comprise iron and silicon, said impurities having a content less than 0.08% by weight and 0.06% by weight for iron and silicon, respectively, the other impurities having a content less than 0.05% by weight each and 0.15% by weight in total.

6. The method according to claim 1 wherein said equivalent time for homogenization is between 6 and 15 hours.

7. The method according to claim 1 wherein the homogenization temperature is about 520° C. and the treatment time is from 8 to 20 hours.

8. The method according to claim 1 wherein said artificial aging is carried out by heating at 148 to 155° C. for 10 to 40 hours.

9. The method according to claim 1 wherein the extruded aluminum alloy product has a density of less than 2.67 g/cm$^3$.

10. The method according to claim 1 wherein the extruded aluminum alloy product has a thickness of at least one elementary rectangle of greater than 8 mm.

11. The method according to claim 10 wherein the extruded aluminum alloy product has a thickness of at least one elementary rectangle of greater than 12 mm.

12. The method according to claim 10 wherein the extruded aluminum alloy product has a thickness of at least one elementary rectangle of greater than 15 mm.

13. The method according to claim 1 wherein the extruded aluminum alloy product has a thickness of at least one elementary rectangle of between 1 mm and 8 mm.

14. The method according to claim 1 wherein the thickness of the extruded product is at least 10 mm.

15. The method according to claim 1 wherein the extruded aluminum alloy product has a toughness thereof KQ(L-T), in the L-T direction is at least 23.7 MPa.

16. The method according to claim 5, wherein said other impurities comprise zinc.

* * * * *